US011600911B2

(12) United States Patent
Kim et al.

(10) Patent No.: US 11,600,911 B2
(45) Date of Patent: Mar. 7, 2023

(54) ANTENNA DEVICE AND DISPLAY DEVICE INCLUDING THE SAME

(71) Applicants: DONGWOO FINE-CHEM CO., LTD., Jeollabuk-do (KR); POSTECH RESEARCH AND BUSINESS DEVELOPMENT FOUNDATION, Gyeongsangbuk-do (KR)

(72) Inventors: Jong Min Kim, Gyeonggi-do (KR); Dong Pil Park, Incheon (KR); Yun Seok Oh, Gyeonggi-do (KR); Won Bin Hong, Seoul (KR)

(73) Assignees: DONGWOO FINE-CHEM CO., LTD., Jeollabuk-Do (KR); POSTECH RESEARCH AND BUSINESS DEVELOPMENT FOUNDATION, Gyeongsangbuk-Do (KR)

( * ) Notice: Subject to any disclaimer, the term of this patent is extended or adjusted under 35 U.S.C. 154(b) by 251 days.

(21) Appl. No.: 17/012,863

(22) Filed: Sep. 4, 2020

(65) Prior Publication Data

US 2020/0403300 A1 Dec. 24, 2020

Related U.S. Application Data

(63) Continuation of application No. PCT/KR2019/002566, filed on Mar. 6, 2019.

(30) Foreign Application Priority Data

Mar. 6, 2018 (KR) ..... 10-2018-0026382

(51) Int. Cl.

| | |
|---|---|
| ***H01Q 1/38*** | (2006.01) |
| ***H01Q 1/24*** | (2006.01) |
| ***H01Q 9/04*** | (2006.01) |

(52) U.S. Cl.
CPC ..... *H01Q 1/38* (2013.01); *H01Q 1/243* (2013.01); *H01Q 9/0407* (2013.01)

(58) Field of Classification Search
CPC ..... H01Q 1/38; H01Q 1/243; H01Q 9/0407; H01Q 1/48; H01Q 21/08
See application file for complete search history.

(56) References Cited

U.S. PATENT DOCUMENTS

2005/0184381 A1 8/2005 Asahi et al.
2006/0066487 A1* 3/2006 Park ..... H01Q 1/38 343/700 MS (Continued)

FOREIGN PATENT DOCUMENTS

CN 1624976 A 6/2005
CN 105514598 A 4/2016

(Continued)

OTHER PUBLICATIONS

Office action dated Apr. 28, 2021 from Korean Patent Office in a counterpart Korean Patent Application No. 10-2018-0026382 (all the cited references are listed in this IDS.) (English translation is also submitted herewith.).

(Continued)

*Primary Examiner* — David E Lotter
(74) *Attorney, Agent, or Firm* — The PL Law Group, PLLC

(57) ABSTRACT

An antenna device according to an embodiment of the present invention includes a dielectric layer, an upper electrode layer disposed on the dielectric layer and including a radiation pattern, a lower electrode layer disposed on the dielectric layer, and a bending connection portion integrally connected to the upper electrode layer and the lower elec- (Continued)

trode layer on the dielectric layer. An interconnection of a ground layer is implemented with high reliability by the bending connection portion.

16 Claims, 10 Drawing Sheets

(56) References Cited

U.S. PATENT DOCUMENTS

| | | | | |
|---|---|---|---|---|
| 2006/0145933 | A1 | 7/2006 | Kim | |
| 2016/0190678 | A1* | 6/2016 | Hong | H01Q 1/44 343/700 MS |
| 2018/0120942 | A1* | 5/2018 | Lee | H01L 41/0477 |

FOREIGN PATENT DOCUMENTS

| | | | |
|---|---|---|---|
| CN | 205828660 | U | 12/2016 |
| CN | 107180848 | A | 9/2017 |
| CN | 107634328 | A | 1/2018 |
| CN | 207009650 | U | 2/2018 |
| CN | 207052758 | U | 2/2018 |
| JP | 2000-138512 | A | 5/2000 |
| JP | 2003-051709 | A | 2/2003 |
| JP | 2003-332830 | A | 11/2003 |
| JP | 2006-040870 | A | 2/2006 |
| JP | 2008-042379 | A | 2/2008 |
| JP | 2008-176240 | A | 7/2008 |
| JP | 2011-244110 | A | 12/2011 |
| JP | 2017-135465 | A | 8/2017 |
| JP | 2017-152904 | A | 8/2017 |
| KR | 10-2006-0109173 | A | 10/2006 |
| KR | 10-2006-0117161 | A | 11/2006 |
| KR | 10-2009-0001038 | A | 1/2009 |
| KR | 10-2011-0062282 | A | 6/2011 |
| KR | 10-2012-0000493 | A | 1/2012 |
| KR | 10-2013-0095451 | A | 8/2013 |
| KR | 10-2014-0071788 | A | 6/2014 |
| KR | 10-2016-0080444 | A | 7/2016 |
| WO | WO 2008/090714 | A1 | 7/2008 |

OTHER PUBLICATIONS

Office action dated Nov. 16, 2021 from Japan Intellectual Property Office in a counterpart Japanese Patent Application No. 2020-546464 (all the cited references are listed in this IDS.) (English translation is also submitted herewith.).

International Search Report for PCT/KR2019/002566 dated Jun. 17, 2019.

* cited by examiner

ANTENNA DEVICE AND DISPLAY DEVICE INCLUDING THE SAME

CROSS REFERENCE TO RELATED APPLICATIONS AND CLAIM OF PRIORITY

The present application is a continuation application to International Application No. PCT/KR2019/002566 with an International Filing Date of Mar. 6, 2019, which claims the benefit of Korean Patent Application No. 10-2018-0026382 filed on Mar. 6, 2018 at the Korean Intellectual Property Office, the disclosures of which are incorporated by reference herein in their entirety.

BACKGROUND

1. Field

The present invention relates to an antenna device and a display device including the same. More particularly, the present invention relates to an antenna device including an electrode and a dielectric layer and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

As mobile communication technologies have been rapidly developed, an antenna capable of operating a high or ultra-high frequency communication is needed in the display device.

Further, as the display device equipped with the antenna becomes thinner and light-weighted, a space for the antenna may be decreased. Accordingly, high-frequency and broadband signal transmission and reception may not be implemented in a limited space.

Thus, a film or patch type antenna may be required for a thin type display device, and researches for improving a radiation reliability in the high-frequency communication even in the thin structure are needed.

For example, an additional interconnecting structure is employed to connect electrodes and pads included in the antenna. When forming the interconnect structure, a thickness of the antenna may increase, and mutual interferences and noises with other pixel structures or sensing structures in the display device may be caused

SUMMARY

According to an aspect of the present invention, there is provided an antenna device having improved signaling efficiency and reliability.

According to an aspect of the present invention, there is provided a display device including an antenna device with improved signaling efficiency and reliability.

(1) An antenna device, including: a dielectric layer; an upper electrode layer disposed on the dielectric layer, the upper electrode layer including a radiation pattern; a lower electrode layer disposed on the dielectric layer; and a bending connection portion integrally connected to the upper electrode layer and the lower electrode layer on the dielectric layer.

(2) The antenna device according to the above (1), wherein the dielectric layer includes an upper dielectric layer, a lower dielectric layer and a bent dielectric portion by which the dielectric layer is bent.

(3) The antenna device according to the above (2), wherein the upper electrode layer is disposed on a top surface of the upper dielectric layer, and the lower electrode layer is disposed on a bottom surface of the lower dielectric layer.

(4) The antenna device according to the above (2), wherein the bending connection portion is disposed on a lateral surface of the bent dielectric portion.

(5) The antenna device according to the above (2), wherein a stepped portion is formed by the upper dielectric layer and the lower dielectric layer.

(6) The antenna device according to the above (5), further including a sensor structure or an optical film disposed on the stepped portion.

(7) The antenna device according to the above (1), wherein the upper electrode layer further includes a ground pad.

(8) The antenna device according to the above (7), wherein the bending connection portion is integrally connected with the ground pad and the lower electrode layer.

(9) The antenna device according to the above (7), wherein the bending connection portion includes a plurality of bending lines branched from the ground pad.

(10) The antenna device according to the above (7), wherein the upper electrode layer further includes a transmission line extending from the radiation pattern to be adjacent to the ground pad.

(11) The antenna device according to the above (7), wherein the upper electrode layer includes a plurality of the radiation patterns and a plurality of the ground pads each of which is coupled to each of the plurality of radiation patterns, and the bending connection portion includes a plurality of bending connection portions, and the lower electrode layer is integrally connected with the plurality of the ground pads via the plurality of the bending connection portions.

(12) The antenna device according to the above (1), wherein the upper electrode layer, the bending connection portion and the lower electrode layer include the same conductive material.

(13) The antenna device according to the above (1), wherein the upper electrode layer and the lower electrode layer include different conductive materials from each other.

(14) The antenna device according to the above (1), wherein the radiation pattern includes a mesh structure.

(15) The antenna device according to the above (14), wherein the lower electrode layer includes a mesh structure.

(16) The antenna device according to the above (14), further including a dummy mesh layer arranged around the radiation pattern.

(17) A display device including the antenna device according to embodiments as described above.

In an antenna device according to embodiments of the present invention, an upper ground pad and a lower electrode layer may be integrally connected by a bending connection portion. Thus, the upper ground pad may be connected to the lower electrode layer so that disturbances in resonance frequency and radiation properties in a radiation pattern may be prevented to improve radiation and signal reliability.

Further, an interconnection between the upper ground pad and a lower ground may be easily implemented by the bending connection portion without additional conductive members such as a contact, a circuit board, etc. Additionally, a thickness increase caused when using the contact or the circuit board and a noise generation from the conductive members may be also prevented.

The antenna device may be applied to a display device including a high or ultrahigh frequency band mobile communication device of 3G, 4G, 5G or more as, e.g., a film antenna shape to improve radiation properties and optical properties such as a transmittance.

DETAILED DESCRIPTION OF THE EMBODIMENTS

According to exemplary embodiments of the present invention, there is provided an antenna device including an upper electrode layer and a lower electrode layer which may be connected to each other by a bending connection portion with a dielectric layer interposed therebetween.

The antenna device may be, e.g., a microstrip patch antenna fabricated in the form of a transparent film. For example, the antenna device may be applied to a device for high frequency band or ultra-high frequency band (e.g., 3G, 4G, 5G or more) mobile communications.

According to exemplary embodiments of the present invention, there is also provided a display device including the antenna device. However, an application of the antenna device is not limited to the display device, and the antenna device may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
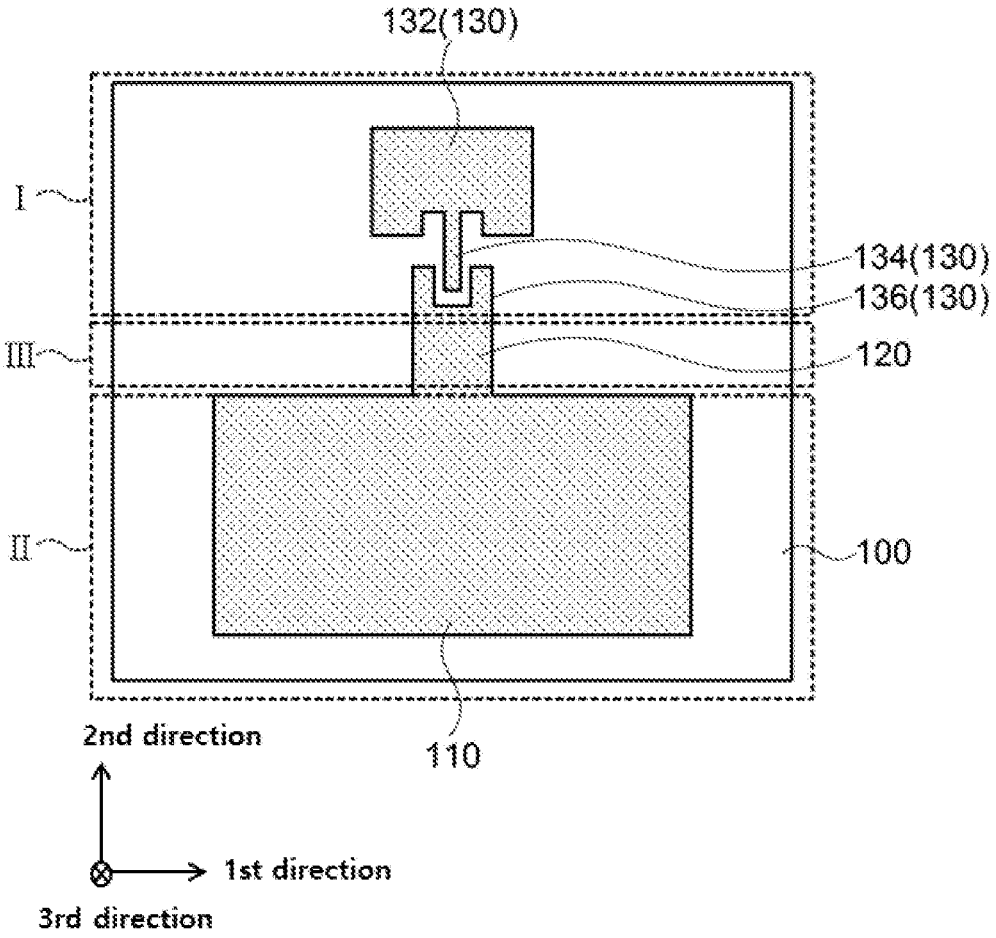
FIG. 1 is a schematic top planar view illustrating an antenna device in accordance with exemplary embodiments.
Figure 2:
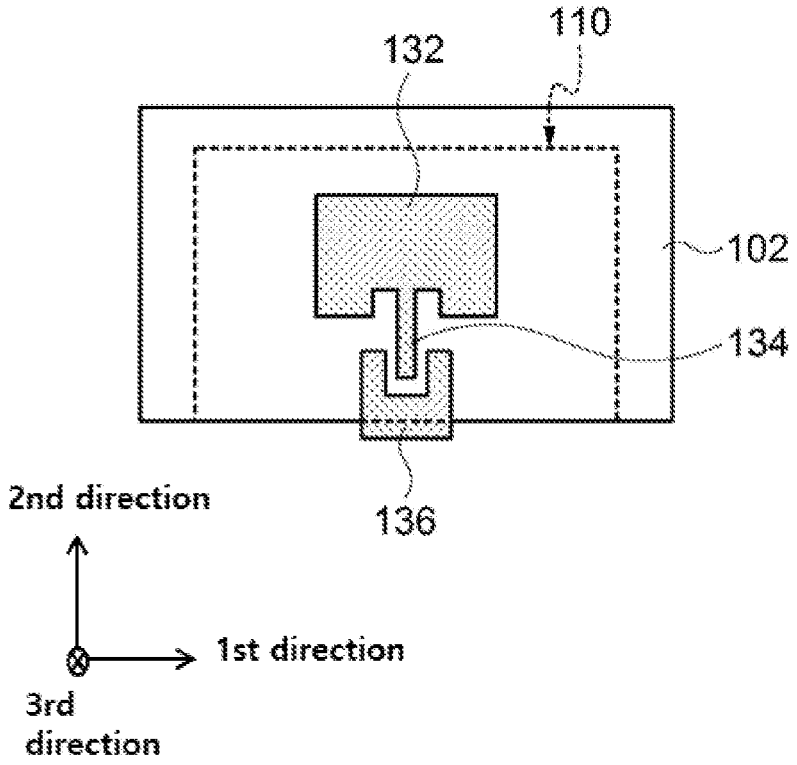
FIGS. 2 to 4 are a top planar view and side views illustrating an antenna device in a bent state in accordance with exemplary embodiments.
Figure 3:
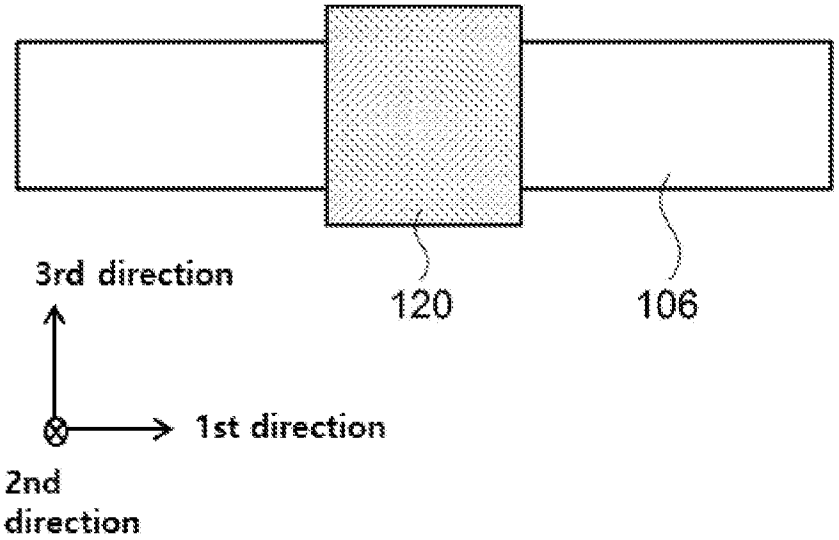
Figure 4:
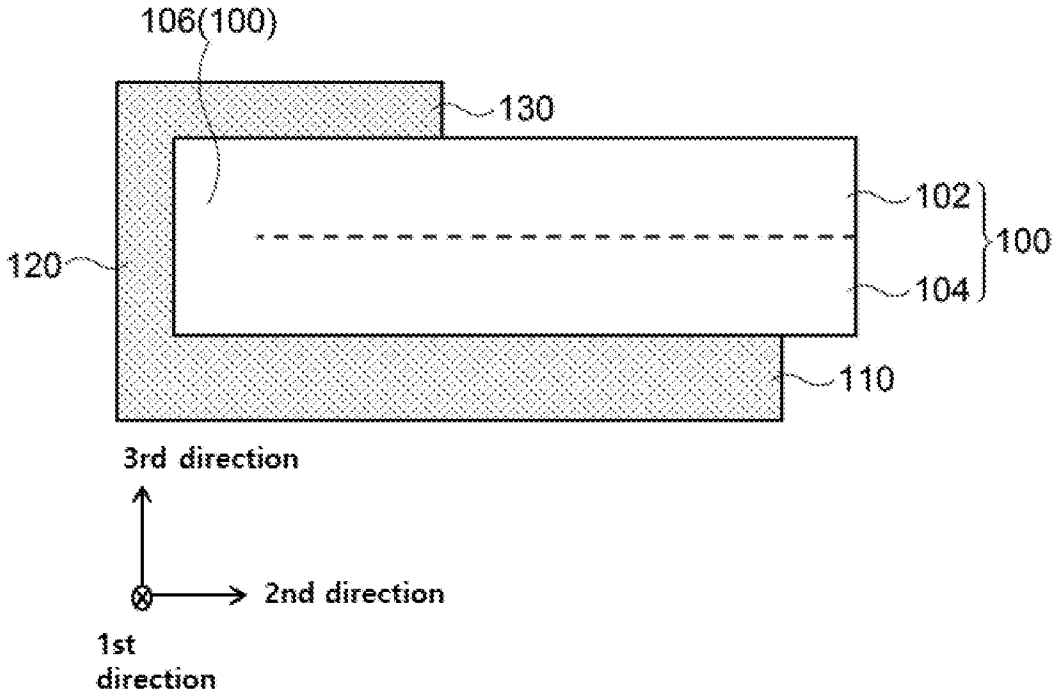

FIG. 1 is a schematic top planar view illustrating an antenna device in accordance with exemplary embodiments. FIGS. 2 to 4 are a top planar view and side views illustrating an antenna device in a bent state in accordance with exemplary embodiments.

Specifically, FIG. 1 is a top planar view illustrating an antenna device before being bent. FIG. 2 is a top planar view of the antenna device after being bent. FIG. 3 is a side view of the antenna device in a second direction after being bent. FIG. 4 is a side view of the antenna device in a first direction after being bent.

In FIG. 1, two directions parallel to a top surface of the dielectric layer 100 and crossing each other are defined as a first direction and a second direction. For example, the first direction and the second direction may be perpendicular to each other. A direction vertical to the top surface of the dielectric layer 100 is defined as a third direction. For example, the first direction may correspond to a width direction of the antenna device, the second direction may correspond to a length direction of the antenna device and the third direction may correspond to a thickness direction of the antenna device. Definitions of the directions may be applied to all accompanying drawings.

Referring to FIG. 1, the antenna device may include an upper electrode layer 130 and a lower electrode layer 110 formed on the dielectric layer 100. The antenna device may include a bending connection portion 120 connecting the lower electrode layer 110 and the upper electrode layer 130.

The dielectric layer 100 may include, e.g., a transparent resin material having flexibility and capable of being folded. For example, the dielectric layer 100 may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth) acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyethersulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; an epoxy-based resin; a urethane or acryl urethane-based resin; a silicone-based resin, etc. These may be used alone or in a combination of two or more thereof.

In some embodiments, an adhesive film such as an optically clear adhesive (OCA), an optically clear resin (OCR), or the like may be included in the dielectric layer 100.

In some embodiments, the dielectric layer 100 may include an inorganic insulating material such as glass, silicon oxide, silicon nitride, silicon oxynitride, etc.

As illustrated in FIG. 1, the dielectric layer 100 may include a first region (I), a second region (II), and a third region (III). In exemplary embodiments, the third region III of the dielectric layer 100 may be provided as a bending region. After the dielectric layer 100 is bent by the third region III, the first region I and the second region II may serve as upper and lower regions, respectively.

A capacitance or an inductance may be formed between the upper electrode layer 130 and the lower electrode layer 110 by the dielectric layer 100 so that a frequency band at which the antenna device may be driven or operated may be adjusted. In some embodiments, a dielectric constant of the dielectric layer 100 may be adjusted in a range from about 1.5 to about 12. When the dielectric constant exceeds about 12, a driving frequency may be excessively reduced so that an antenna driving in a desired high frequency band may not be realized.

The upper electrode layer 130 may be disposed on the first region I of the dielectric layer 100 and may include a radiation pattern 132 and a ground pad 136. The upper electrode layer 130 may further include a transmission line 134 branching and extending from the radiation pattern 132. For example, the transmission line 134 may extend from a central portion of the radiation pattern 132 toward the ground pad 136.

The ground pad 136 may be disposed around an end portion of the transmission line 134. For example, the ground pad 136 may include a recess, and the end portion of the transmission line 134 may be inserted into the recess. In an embodiment, the end portion of the transmission line 134 may be disposed adjacent to the ground pad 136 in the recess while being spaced apart from the ground pad 136.

The ground pad 136 may be disposed around the transmission line 134, so that noises generated when transmitting and receiving a radiation signal through the transmission line 134 may be efficiently filtered or reduced.

The lower electrode layer 110 may be disposed on the second region II of the dielectric layer 100. In exemplary embodiments, the lower electrode layer 110 may serve as a lower ground layer of the antenna device.

As illustrated in FIG. 1, the lower electrode layer 110 may have a larger area than that of the upper electrode layer (e.g., the radiation pattern 132) in a planar view. In some embodiments, lengths of the lower electrode layer 110 in the first direction and the second direction may be larger than those of the upper electrode layer 130.

The bending connection portion 120 may be disposed on the third region III of the dielectric layer 100. In exemplary embodiments, the bending connection portion 120 may electrically connect the lower electrode layer 110 and the upper electrode layer 130 to each other. Further, the bending connection portion 120 may be provided as a substantially single member integrally connected to the lower electrode layer 110 and the upper electrode layer 130.

In some embodiments, the bending connection portion 120 may be integrally connected to the lower electrode layer 110 and the ground pad 136 of the upper electrode layer 130.

The upper electrode layer 130, the lower electrode layer 110 and the bending connection portion 120 may include the same conductive material or different conductive materials from each other. In some embodiments, the upper electrode layer 130, the lower electrode layer 110 and the bending connection portion 120 may include the same metallic material. In this case, the upper electrode layer 130, the lower electrode layer 110 and the bending connection portion 120 may be formed simultaneously through a substantially single patterning process.

For example, the upper electrode layer 130, the lower electrode layer 110 and the bending connection portion 120 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy containing at least one of the metals. These may be used alone or in combination thereof.

For example, silver (Ag) or a silver alloy (e.g., a silver-palladium-copper (APC) alloy) may be used for implementing a low resistance. In an embodiment, the upper electrode layer 130, the lower electrode layer 110 and the bending connection portion 120 may include copper (Cu) or a copper alloy (e.g., a copper-calcium (Cu—Ca) alloy) in consideration of low resistance and pattern formation with a fine line width.

In some embodiments, the upper electrode layer 130 and the lower electrode layer 110 may include different conductive materials from each other. For example, the upper electrode layer 130 may include the above-described metal or alloy, and the lower electrode layer 110 may include a transparent conductive oxide such as indium tin oxide (ITO) or indium zinc oxide (IZO).

Referring to FIGS. 2 to 4, the antenna device illustrated in FIG. 1 may be bent and folded through the third region III of the dielectric layer 100. Accordingly, the upper electrode layer 130 and the lower electrode layer 110 may overlap in the third direction as illustrated in FIGS. 2 and 4.

The dielectric layer 100 may be folded so that the dielectric layer 100 may be divided into an upper dielectric layer 102 and a lower dielectric layer 104. Additionally, the third region III of the dielectric layer 100 may be converted into a bent dielectric portion 106. For example, the dielectric layer 100 may be substantially completely folded through the bent dielectric portion 106 so that the upper dielectric layer 102 and the lower dielectric layer 104 may contact each other.

Accordingly, the upper electrode layer 130 may be disposed on a top surface of the upper dielectric layer 102, and the lower electrode layer 110 may be disposed on a bottom surface of the lower dielectric layer 104. As illustrated in FIG. 3, the bending connection portion 120 may be bent together along a lateral surface of the bent dielectric portion 106. The bending connection portion 120 may be integrally connected to the ground pad 136 and the lower electrode layer 110 on the lateral surface of the bent dielectric portion 106.

As indicated by a dotted line in FIG. 2, the lower electrode layer 110 may entirely cover the upper electrode layer 130 or the radiation pattern 132 in a planar view. Accordingly, an efficiency of forming the inductance through the dielectric layer 100 may be increased, and a grounding efficiency may be also improved by being connected to the ground pad 136.

As described above, the ground pad 136 of the upper electrode layer 130 and the lower electrode layer 110 may be connected to each other through the bending connection portion 120. Accordingly, a noise or signal interference that may occur from the ground pad 136 may be grounded and removed through the lower electrode layer 110. Thus, reliable signal transmission and reception may be implemented without changing radiation properties such as a resonance frequency of the radiation pattern 132.

Additionally, according to exemplary embodiments, the interconnection of the upper and lower electrode layers may be easily achieved by bending of the bending connection portion 120 integrally formed with the ground pad 136 and the lower electrode layer 110.

In a comparative example, in order to connect an upper electrode and a lower electrode of an antenna, a contact may be formed in a dielectric layer or a printed circuit board (FPCB) may be used. However, when the contact is utilized, a thickness of the dielectric layer is increased in consideration of an etching process, and an inductance within the dielectric layer may be disturbed. Further, when using the FPCB, a manufacturing cost increases, and noises caused by a bonding member may also increase.

However, according to exemplary embodiments described above, after initially forming the bending connecting portion 120 on the same plane with the ground pad 136 and the lower electrode layer 110, the upper and lower electrode layers 130 and 110 may be defined by bending the dielectric layer 100. Thus, the interconnection of the upper and lower electrode layers 130 and 110 may be easily implemented without additional conductive members such as the contact and the FPCB.

Figure 5:
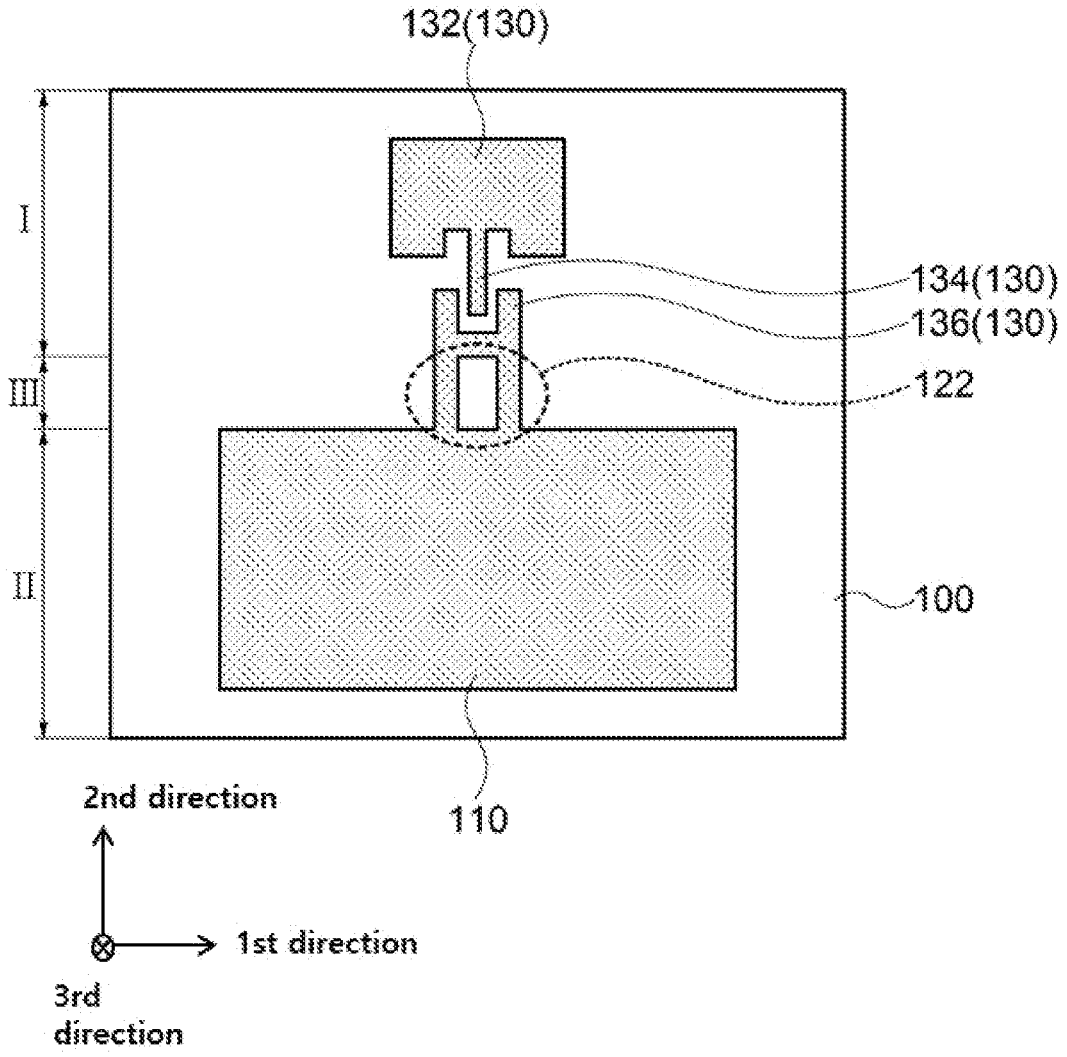
FIG. 5 is a schematic top planar view illustrating an antenna device in accordance with some exemplary embodiments.
Figure 6:
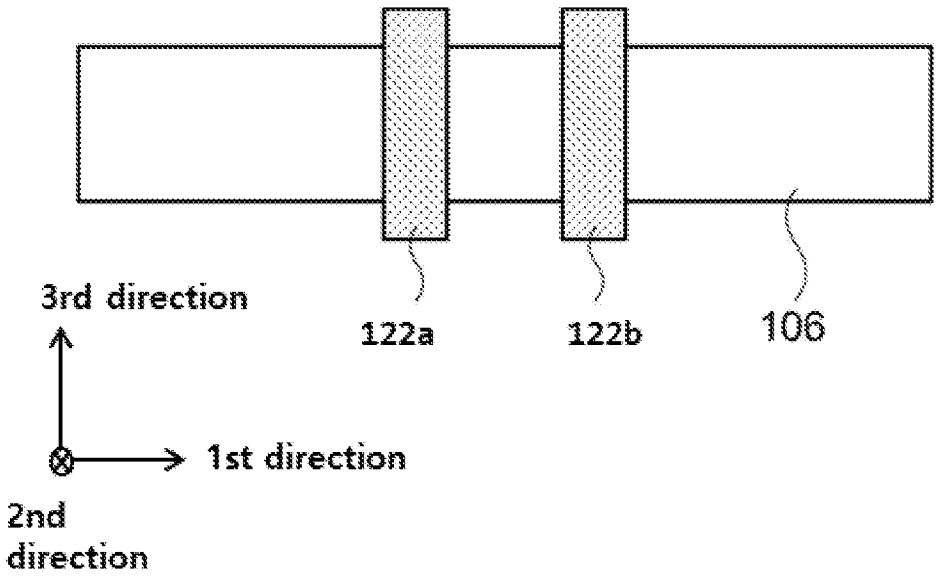
FIG. 6 is a side view illustrating an antenna device in a bent state in accordance with some exemplary embodiments.

FIG. 5 is a schematic top planar view illustrating an antenna device in accordance with some exemplary embodiments. FIG. 6 is a side view illustrating an antenna device in a bent state in accordance with some exemplary embodiments. Detailed descriptions on elements and/or structures substantially the same as or similar to those described with reference to FIGS. 1 to 4 are omitted herein.

Referring to FIGS. 5 and 6, a bending connection portion 122 may be disposed on the third region III of the dielectric layer 100 or the bent dielectric portion 106. In some embodiments, the bending connection portion 122 may include a plurality of bending lines.

For example, the bending connecting portion 122 may include a first bending line 122*a* and a second bending line 122*b*. The first bending line 122*a* and the second bending line 122*b* may be branched from the ground pad 136 and may be integrally connected to the lower electrode layer 110.

The bending connection portion 122 may be divided into a plurality of the bending lines, so that a stress generated during the bending operation may be dispersed. Thus, an electrical connection failure due to cracks or fractures of the bending connecting portion 122 may be prevented during the bending operation.

Figure 7:
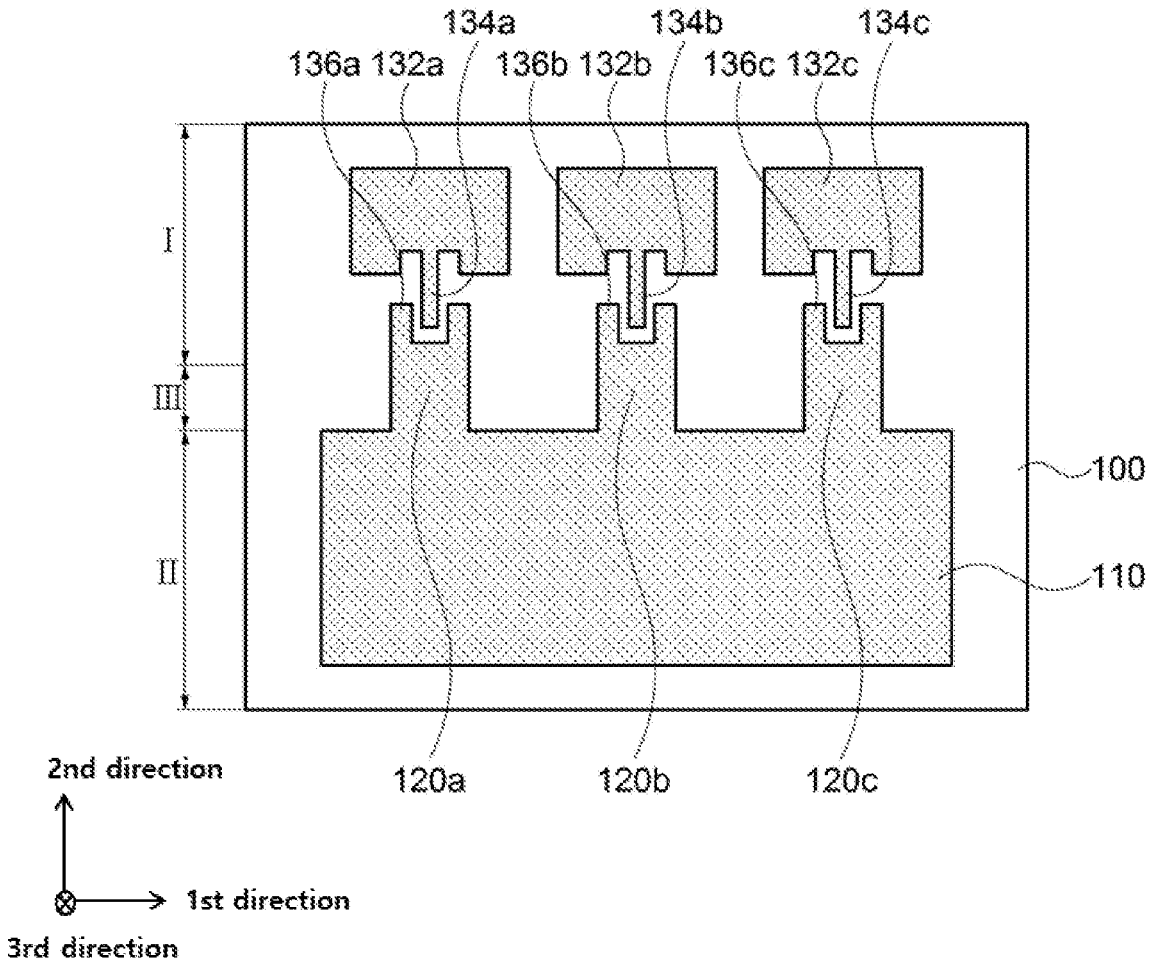
FIG. 7 is a schematic top planar view illustrating an antenna device in accordance with some exemplary embodiments.

FIG. 7 is a schematic top planar view illustrating an antenna device in accordance with some exemplary embodiments.

Referring to FIG. 7, the upper electrode layer may include a plurality of radiation patterns, and a plurality of ground pads may each be electrically connected to the lower electrode layer 110 via each of bending connection portions.

In some embodiments, the upper electrode layer may include a first radiation pattern 132*a*, a second radiation pattern 132*b* and a third radiation pattern 132*c*. The first to third radiation patterns 132*a*, 132*b* and 132*c* may be coupled to first to third ground pads 136*a*, 136*b* and 136*c* via first to third transmission lines 134*a*, 134*b* and 134*c*, respectively.

First to third bending connecting portions 120*a*, 120*b* and 120*c* may extend from the first to third ground pads 136*a*, 136*b* and 136*c*, respectively, and may be integrally connected to the lower electrode layer 110.

The bending connection portions 120*a*, 120*b* and 120*c* may be bent together through the third region III of the dielectric layer 100 such that the lower electrode layer 110 may face the radiation patterns 132*a*, 132*b* and 132*c* with the dielectric layer 100 interposed therebetween.

The lower electrode layer 110 may have a sufficient area to cover all of the first to third radiation patterns 132*a*, 132*b*, and 132*c* in a planar view after the bending.

A plurality of the ground pads 136*a*, 136*b* and 136*c* may be connected through the lower electrode layer 110 so that a resistance of grounding and absorbing noise may be reduced. In some embodiments, the first to third radiation patterns 132*a*, 132*b* and 132*c* may have different phases. In this case, a phased array antenna may be implemented through one lower electrode layer 110, so that an efficiency of signal transmission and reception may be improved.

Figure 8:
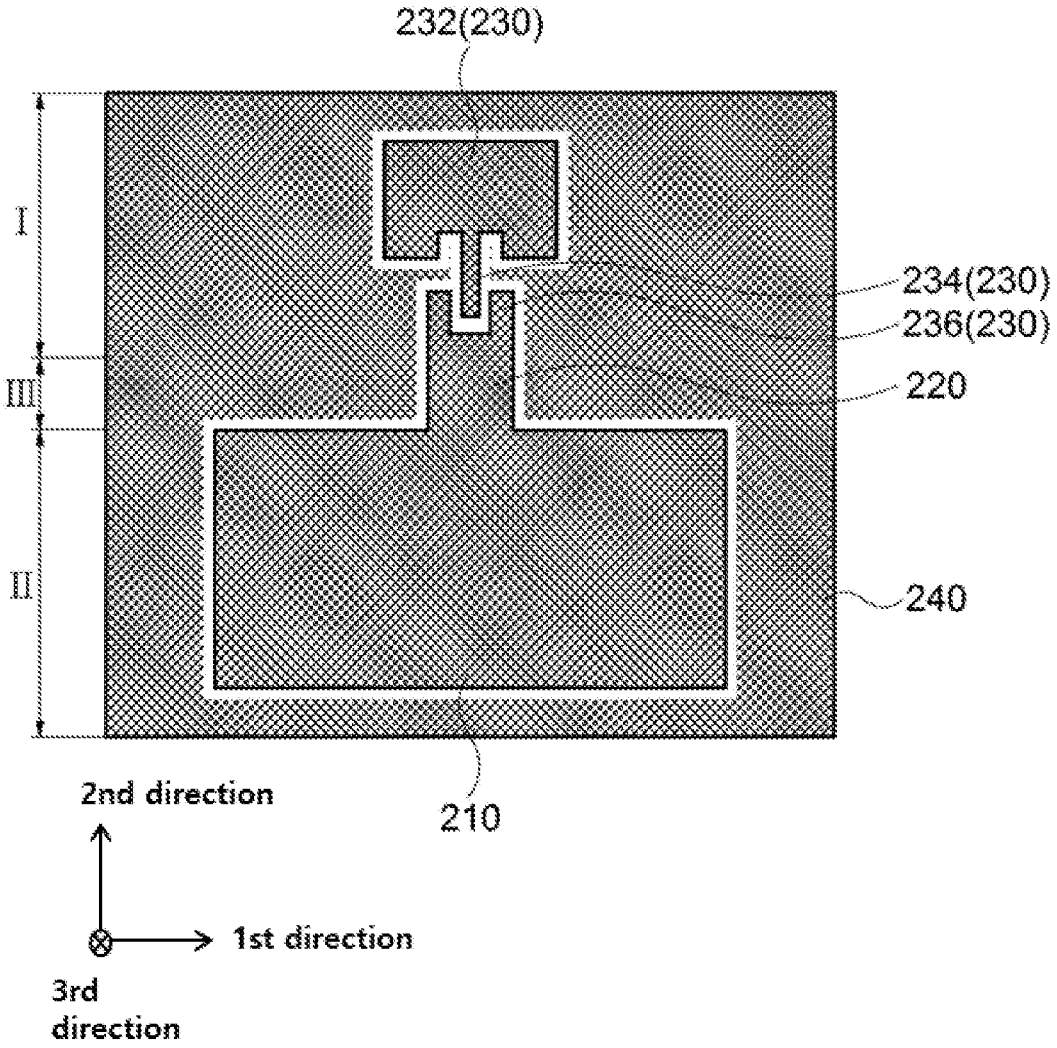
FIG. 8 is a schematic top planar view illustrating an antenna device in accordance with some exemplary embodiments.

FIG. 8 is a schematic top planar view illustrating an antenna device in accordance with some exemplary embodiments.

Referring to FIG. 8, an upper electrode layer 230 of the antenna device may include a mesh structure. In exemplary embodiments, the radiation pattern 232 may include the mesh structure, and thus transmittance of the antenna device may be improved.

A dummy mesh layer 240 may be disposed on the dielectric layer around the radiation pattern 232. The dummy mesh layer 240 and the radiation pattern 232 may include a mesh structure having substantially the same shape. An electrode arrangement around the radiation pattern 232 may become uniform by the dummy mesh layer 240 to prevent the mesh structure or the electrode lines included therein from being viewed by a user of a display device to which the antenna device is applied.

For example, a mesh metal layer may be formed on the dielectric layer 100, and the mesh metal layer may be cut along a predetermined area to electrically and physically separate the dummy mesh layer 240 from the radiation pattern 232.

In some embodiments, a transmission line 234 and a ground pad 236 of the upper electrode layer 230, a bending connection portion 220 and/or a lower electrode layer 210 may also include the mesh structure. Additionally, the dummy mesh layer 240 may be formed throughout the first region (I), the second region (II) and the third region (III) of the dielectric layer 100 to be disposed around the bending connection portion 220 and the lower electrode layer 210.

Figure 9:
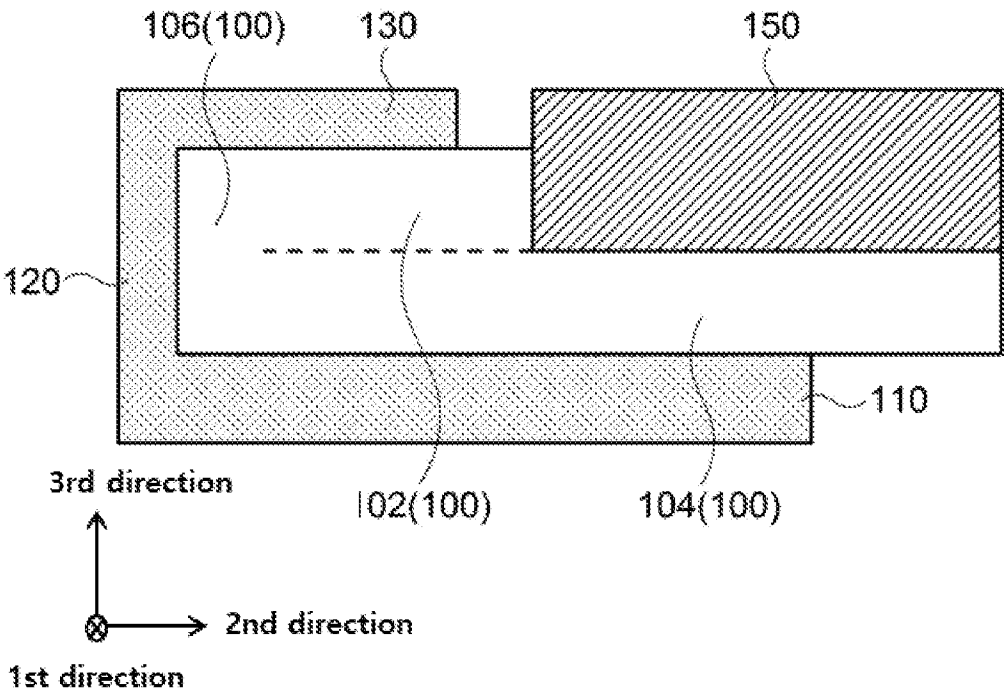
FIG. 9 is a schematic side view illustrating an antenna device in accordance with some exemplary embodiments.

FIG. 9 is a schematic side view illustrating an antenna device in accordance with some exemplary embodiments.

Referring to FIG. 9, as described above, the dielectric layer 100 may be bent through the bent dielectric portion 106 so that the upper dielectric layer 102 and the lower dielectric layer 104 may be defined.

A length in the second direction of the lower dielectric layer 104 may be greater than that of the upper dielectric layer 102 so that the lower electrode layer 110 disposed on a bottom surface of the lower dielectric layer 104 may sufficiently cover the upper electrode layer 130. Accordingly, a stepped portion may be generated by a portion that may not be covered by the upper dielectric layer 102.

In exemplary embodiments, a functional structure 150 may be disposed on a top surface of the lower dielectric layer 104 exposed by the stepped portion so that the stepped portion may be removed and a spatial efficiency may be enhanced.

For example, the functional structure 150 may include a sensor structure such as a touch sensor, an IOT sensor, etc., or an optical film such as a polarizing plate, a retarder, etc., included in a display device.

Figure 10:
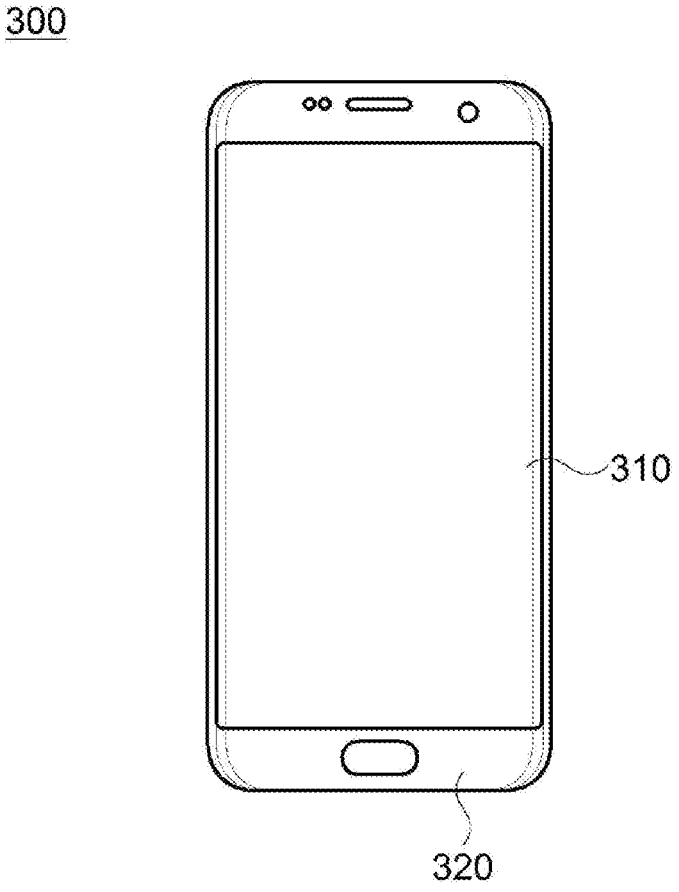
FIG. 10 is a schematic top planar view illustrating a display device in accordance with exemplary embodiments.

FIG. 10 is a schematic top planar view illustrating a display device in accordance with exemplary embodiments. For example, FIG. 10 illustrates an outer shape including a window of a display device.

Referring to FIG. 10, a display device 300 may include a display area 310 and a peripheral area 320. The peripheral area 320 may be disposed on both lateral portions and/or both end portions of the display area 310.

In some embodiments, the above-described antenna device may be inserted in the peripheral area 320 of the display device 300 as a patch or a film shape. In some embodiments, the radiation pattern and the lower electrode layer of the antenna device may overlap the display area 310. As described above, the lower electrode layer may be bent via the bending connection portion and disposed in the display area 310 together with the radiation pattern. For example, as illustrated in FIG. 8, the radiation pattern may be prevented from being recognized by a user by utilizing the mesh structure.

The peripheral area 320 may correspond to, e.g., a light-shielding portion or a bezel portion of the image display device. An integrated circuit (IC) chip for controlling driving properties and radiation properties of the antenna device and providing a feeding signal may be disposed in the peripheral area 320.

What is claimed is:

1. An antenna device, comprising:

a dielectric layer;

an upper electrode layer disposed on the dielectric layer, the upper electrode layer comprising:

a radiation pattern;

a ground pad; and a transmission line extending from the radiation pattern to be adjacent to the ground pad;

a lower electrode layer disposed on the dielectric layer; and a bending connection portion integrally connected to the upper electrode layer and the lower electrode layer on the dielectric layer.

2. The antenna device according to claim 1, wherein the dielectric layer comprises an upper dielectric layer, a lower dielectric layer and a bent dielectric portion by which the dielectric layer is bent.

3. The antenna device according to claim 2, wherein the upper electrode layer is disposed on a top surface of the upper dielectric layer, and the lower electrode layer is disposed on a bottom surface of the lower dielectric layer.

4. The antenna device according to claim 2, wherein the bending connection portion is disposed on a lateral surface of the bent dielectric portion.

5. The antenna device according to claim 2, wherein a stepped portion is formed by the upper dielectric layer and the lower dielectric layer.

6. The antenna device according to claim 5, further comprising a sensor structure or an optical film disposed on the stepped portion.

7. The antenna device according to claim 1, wherein the bending connection portion is integrally connected with the ground pad and the lower electrode layer.

8. The antenna device according to claim 1, wherein the bending connection portion comprises a plurality of bending lines branched from the ground pad.

9. The antenna device according to claim 1, wherein the upper electrode layer comprises a plurality of the radiation patterns and a plurality of the ground pads each of which is coupled to each of the plurality of radiation patterns; and the bending connection portion comprises a plurality of bending connection portions, and the lower electrode layer is integrally connected with the plurality of the ground pads via the plurality of the bending connection portions.

10. The antenna device according to claim 1, wherein the upper electrode layer, the bending connection portion and the lower electrode layer comprise the same conductive material.

11. The antenna device according to claim 1, wherein the upper electrode layer and the lower electrode layer comprise different conductive materials from each other.

12. The antenna device according to claim 1, wherein the radiation pattern comprises a mesh structure.

13. The antenna device according to claim 12, wherein the lower electrode layer comprises a mesh structure.

14. The antenna device according to claim 12, further comprising a dummy mesh layer arranged around the radiation pattern.

15. A display device comprising the antenna device according to claim 1.

16. An antenna device, comprising:

a dielectric layer comprising an upper dielectric layer, a lower dielectric layer, and a bent dielectric portion by which the dielectric layer is bent;

an upper electrode layer disposed on a top surface of the upper dielectric layer, the upper electrode layer comprising a radiation pattern;

a lower electrode layer disposed on a bottom surface of the lower dielectric layer; and a bending connection portion integrally connected to the upper electrode layer and the lower electrode layer on the dielectric layer.

* * * * *